US009847589B2

(12) United States Patent
Shaw

(10) Patent No.: US 9,847,589 B2
(45) Date of Patent: Dec. 19, 2017

(54) COUPLING CONTINUITY CONNECTOR

(71) Applicant: PERFECTVISION MANUFACTURING, INC., Little Rock, AR (US)

(72) Inventor: Glen David Shaw, Conway, AR (US)

(73) Assignee: PerfectVision Manufacturing, Inc., Little Rock, AR (US)

( * ) Notice: Subject to any disclaimer, the term of this patent is extended or adjusted under 35 U.S.C. 154(b) by 0 days.

(21) Appl. No.: 14/636,064

(22) Filed: Mar. 2, 2015

(65) Prior Publication Data

US 2015/0194747 A1 Jul. 9, 2015

Related U.S. Application Data

(63) Continuation of application No. 13/941,317, filed on Jul. 12, 2013, now Pat. No. 8,968,025, which is a continuation-in-part of application No. 13/589,666, filed on Aug. 20, 2012, now Pat. No. 9,190,773, which is a continuation-in-part of application No. 13/374,378, filed on Dec. 27, 2011, now Pat. No. 8,636,541.

(51) Int. Cl.

| | |
|---|---|
| ***H01R 9/05*** | (2006.01) |
| ***H01R 13/24*** | (2006.01) |
| ***H01R 13/622*** | (2006.01) |
| *H01R 13/17* | (2006.01) |

(52) U.S. Cl.

CPC ..... *H01R 9/0521* (2013.01); *H01R 13/2421* (2013.01); *H01R 13/622* (2013.01); *H01R 13/17* (2013.01)

(58) Field of Classification Search

CPC ..... H01R 9/0524; H01R 9/05; H01R 9/0521; H01R 9/0527; H01R 9/0512; H01R 9/0518; H01R 9/053

See application file for complete search history.

(56) References Cited

U.S. PATENT DOCUMENTS

| | | | | |
|---|---|---|---|---|
| 3,823,292 | A | 7/1974 | Murata | |
| 3,835,443 | A * | 9/1974 | Arnold | H01R 13/65802 439/319 |
| 4,462,033 | A | 7/1984 | Grashow | |
| 4,824,400 | A | 4/1989 | Spinner | |
| 4,857,015 | A | 8/1989 | Michaels | |
| 4,915,651 | A | 4/1990 | Bout | |
| 4,934,666 | A | 6/1990 | Balsells | |
| 5,061,191 | A | 10/1991 | Casciotti | |
| 5,083,943 | A | 1/1992 | Tarrant | |
| 5,310,359 | A | 5/1994 | Chadbourne | |
| 5,454,735 | A | 10/1995 | Nelson | |
| 5,470,257 | A | 11/1995 | Szegda | |
| 5,795,188 | A | 8/1998 | Harwath | |
| 5,938,474 | A | 8/1999 | Nelson | |
| 6,666,690 | B2 | 12/2003 | Ishizuka et al. | |
| 6,781,390 | B2 | 8/2004 | Kazama | |
| 6,873,168 | B2 | 3/2005 | Kazama | |

(Continued)

FOREIGN PATENT DOCUMENTS

WO 2010046242 A2 4/2010

*Primary Examiner* — Ross Gushi

(74) *Attorney, Agent, or Firm* — Paul D. Chancellor; Ocean Law

(57) ABSTRACT

A coaxial connector including a continuity element extending between a nut surface and a body base.

21 Claims, 11 Drawing Sheets

(56) References Cited

U.S. PATENT DOCUMENTS

| | | | | |
|---|---|---|---|---|
| 6,908,337 | B1 | 6/2005 | Li | |
| 7,055,812 | B2 * | 6/2006 | Balsells | F16F 1/045 267/166 |
| 7,131,867 | B1 | 11/2006 | Foster | |
| 7,727,013 | B1 | 6/2010 | Paynter | |
| 8,167,285 | B2 * | 5/2012 | Balsells | F16B 21/18 267/1.5 |
| 8,282,429 | B2 | 10/2012 | Glick | |
| 8,337,229 | B2 | 12/2012 | Montena | |
| 8,393,919 | B2 | 3/2013 | Islam | |
| 8,491,345 | B2 | 7/2013 | Leon | |
| 2012/0135639 | A1 * | 5/2012 | Paglia | H01R 13/6583 439/607.41 |
| 2013/0023151 | A1 | 1/2013 | Holliday | |

* cited by examiner

COUPLING CONTINUITY CONNECTOR

PRIORITY AND INCORPORATION BY REFERENCE

This application is a continuation of Ser. No. 13/941,317 filed Jul. 12, 2013 which is a continuation in part of U.S. patent application Ser. No. 13/589,666 filed Aug. 20, 2012 which is a continuation in part of U.S. patent application Ser. No. 13/374,378 filed Dec. 27, 2011 now U.S. Pat. No. 8,636,541. Incorporated herein, in their entireties and for all purposes, are the disclosures of: U.S. patent application Ser. Nos. 13/941,317, 13/589,666 filed Aug. 20, 2012 and Ser. No. 13/374,378 filed Dec. 27, 2011; and, U.S. Pat. No. 7,841,896 B1 which issued from U.S. patent application Ser. No. 12/380,327 filed Feb. 26, 2009.

BACKGROUND OF THE INVENTION

Coaxial cable connectors are well-known in various applications including those of the satellite and cable television industry. Coaxial cable connectors including F-Type connectors used in consumer applications such as cable and satellite cable connectors are a source of service calls when service is interrupted by lost and/or intermittent coaxial cable connections typically involving a junction between a male F-type connector terminating a coaxial cable and a female F-type port located on related equipment.

Field of Invention

This invention relates to the electromechanical arts. In particular, the invention provides an electrical connector suitable for terminating a coaxial cable having a center conductor and a ground conductor surrounding the center conductor.

Discussion of the Related Art

Coaxial cable connectors include variants designed to improve electrical continuity under extenuating circumstances. Some of these continuity improving connectors are connectors designed to simulate tight mechanical engagement of male and female connectors. Others are designed as electrically conductive bridges between conductive parts.

SUMMARY OF THE INVENTION

The present invention provides coaxial cable connectors such as a male F-Type coaxial cable connector. Various embodiments described herein include features for improving electrical continuity.

In an embodiment, a coaxial cable connector comprises: a coupling having a forward mouth and a trailing socket; a body coaxially arranged with respect to the coupling; the body having a base and a groove in a periphery of the base; a coil spring seated in the groove of the base and the base inserted in the socket of the coupling; the base and a socket interior surface spaced apart and defining a circumferential gap; the spring having at least one peak including a coil of a peak diameter; flanking spring portions to either side of the peak; the flanking spring portions having coils of one or more diameters no one of which is as large as the peak diameter; spring coils adjacent to the peak diameter coil contained within the groove; and, the peak diameter coil extending from the groove and contacting the socket interior surface.

DESCRIPTION OF THE DRAWINGS

The present invention is described with reference to the accompanying figures. These figures, incorporated herein and forming part of the specification, illustrate embodiments of the present invention and, together with the description, further serve to explain the principles of the invention and to enable a person skilled in the relevant art to make and use the invention.

DETAILED DESCRIPTION OF THE PREFERRED EMBODIMENTS

The disclosure provided in the following pages describes examples of some embodiments of the invention. The designs, figures, and descriptions are non-limiting examples of certain embodiments of the invention. For example, other embodiments of the disclosed device may or may not include the features described herein. Moreover, disclosed advantages and benefits may apply to only certain embodiments of the invention and should not be used to limit the disclosed inventions.

As used herein, coupled means directly or indirectly connected by a suitable means known to persons of ordinary skill in the art. Coupled items may include interposed features such as, for example, A is coupled to C via B. Unless otherwise stated, the type of coupling, whether it be mechanical, electrical, fluid, optical, radiation, or other is provided by the context in which the term is used.

Figure 1A:
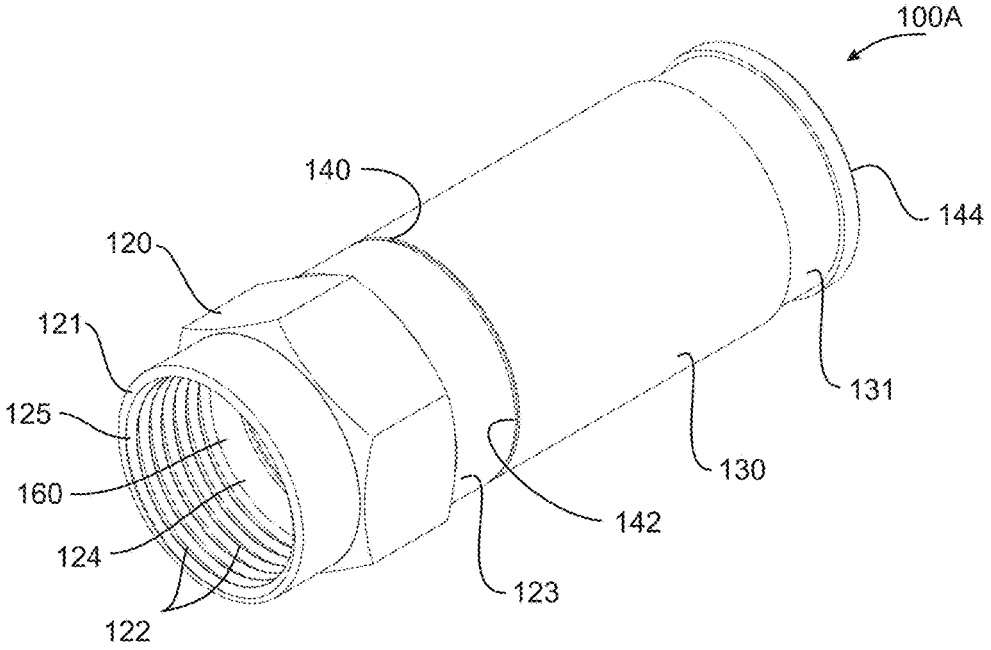
FIGS. 1A, B show perspective views of a male, F-type coaxial cable connector in accordance with the present invention.

FIG. 1A shows a perspective view of an F-type coaxial cable connector 100A. As seen, the connector includes a coupling such as a nut 120 that is adjacent to a sleeve-like portion such as an end cap or sleeve 130. As is further described below, relative motion between the end cap, nut, and underlying connector parts serves to fix the connector to a coaxial cable inserted in the connector. While embodiments of the present invention are not limited to particular connector types, connector attributes (male/female), or methods of cable/connector affixation, the disclosure of applicant's U.S. Pat. No. 7,841,896 B1 provides some illustrative examples of connectors such as male F-Type connectors, connector affixations, and coaxial cables used therewith.

The nut 120 has a front end 121 near a mouth 125 leading to a central chamber 124. Visible in the central chamber is a post flange 160 similar to those discussed below. Adjacent to the nut mouth are nut internal threads 122 for affixing the nut to a mating female coaxial connector. Near a nut rear end 140, the nut includes a shroud or socket 123.

As shown, the connector end cap 130 can be located adjacent to the nut 120. Here, an end cap front end 142 is adjacent to the socket 123. Generally opposed to the end cap front end is an end cap rear end 144. Some embodiments include an external end cap groove 131 encircling a periphery of the end cap near the rear end. In various embodiments, groove functions include seating a circular band such as a circular elastomeric band and/or aiding in one or more of identification, assembly, and use of the connector 100A.

Figure 1B:
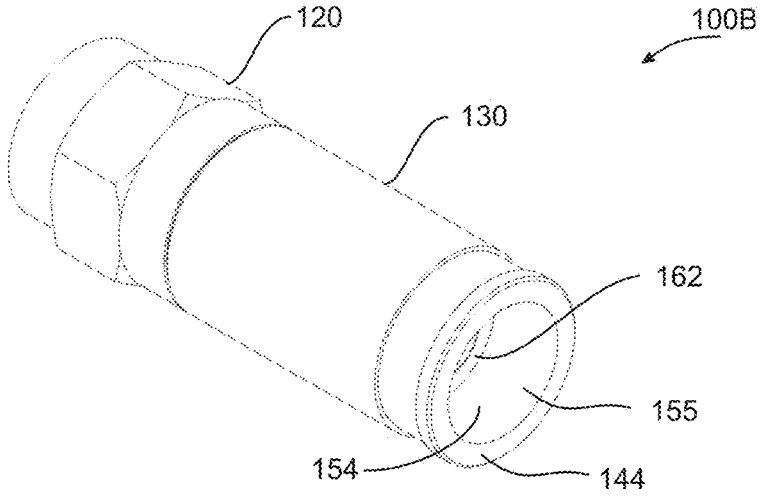

FIG. 1B shows a perspective view of the connector of FIG. 1A 100B. The nut 120 is shown adjacent to the end cap 130 and the rear end 144 of the end cap is turned to show the end cap mouth 155 leading to a central chamber 154. Visible in the central chamber is a post end 162 similar to those discussed below.

Figure 2A:
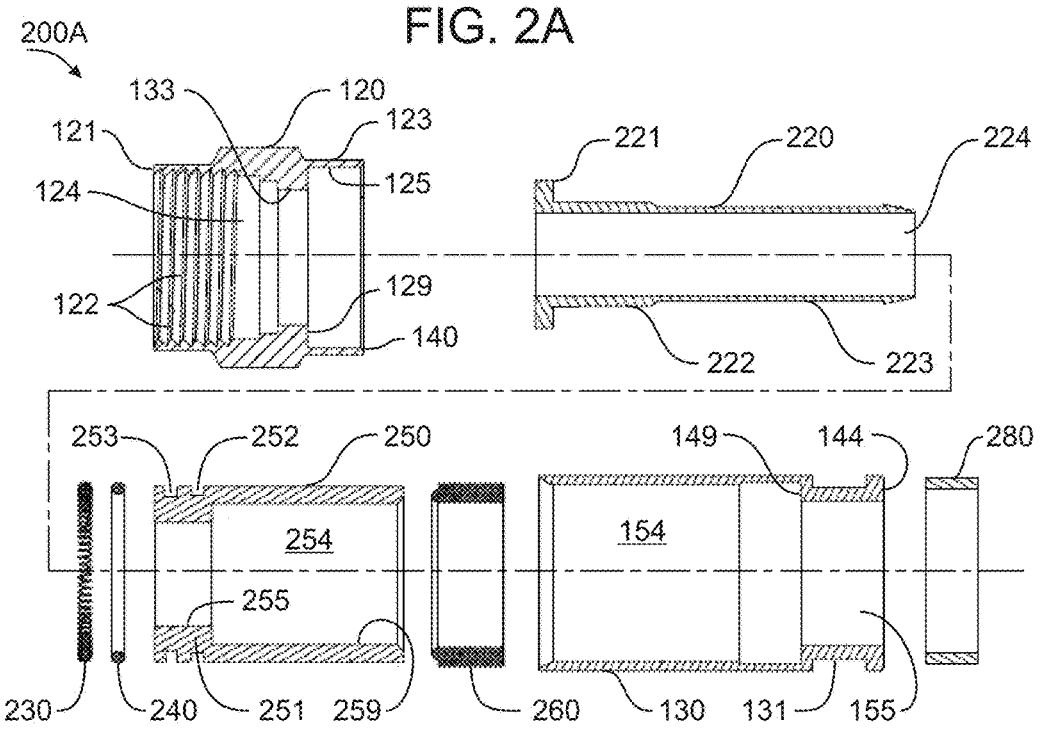
FIGS. 2A, B show exploded views of the connector of FIG. 1A above.
Figure 2B:
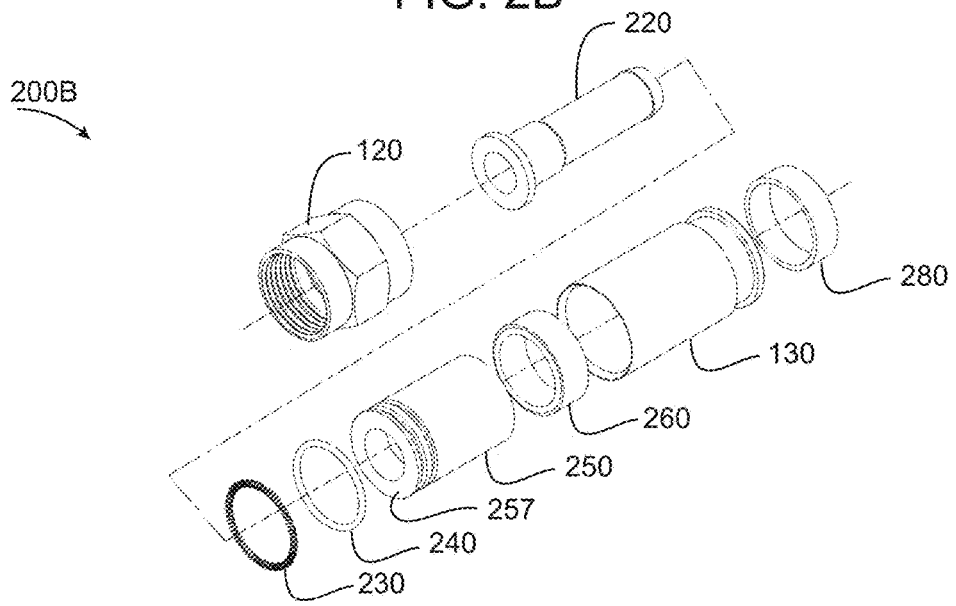

FIGS. 2A, B show a cross-sectional exploded view of a connector assembly similar to the connector of FIG. 1A 200A, 200B. Structural connector parts include the nut 120, a post such as a tubular post 220, a body such as a cylindrical body 250, and a sleeve or end cap 130. Used in conjunction with these structural parts is a group of fitted parts including one or more of a body mounted continuity member such as a spring 230, a body mounted ring such as an O-Ring 240, a coaxial cable encircling ring such as a dual diameter ring 260, and an end cap encircling ring such as an end cap band 280.

Spring materials include any of those known by skilled artisans to be suitable including resilient electrical conductors. Useful metals and/or their alloys include iron, steel, copper, nickel, beryllium, and the like. In an embodiment, the spring is made from a stainless steel and in an embodiment the spring is made from an alloy comprising beryllium and/or copper. In some embodiments, the spring is coated as with gold or another material which may be selected to reduce rubbing friction between the spring and a contacting part such as a coupling.

The post 220 rotatably couples with a coupling such as a nut 120 and fixedly couples with the body 250. In particular, embodiments provide an inwardly directed rim of the nut 133 that is forward of the socket 123. The rim engages a post end flange 221 to provide the rotatable nut/post coupling. A post shank 223 is configured to tightly engage an inwardly directed body collar 255 of a body base 251. In some embodiments, the post portion engaging the collar is a thickened or amended portion of the tubular post shank forming a post shank shoulder 222.

Mentioned above are the continuity member 230 and body mounted ring 240. Each of these fitments encircles the body base 251. In particular, embodiments provide adjacent body base grooves such as forward 253 and trailing 252 body grooves for seating the continuity member and ring. In some embodiments, the continuity member is in the forward groove while the ring is in the rear groove. And, in some embodiments the continuity member is in the rear groove while the ring is in the forward groove.

Embodiments of the connector provide an assembly wherein the dual diameter ring is a seal and/or a coaxial cable fixing member. During assembly of the connector to a coaxial cable, the seal is pushed forward by an internal annular shoulder 149 of the end cap 130. Configured to be forced into the central chamber 254 of the body 250, movement of the end cap 130 onto the body results in the seal being pushed into the body central chamber such that it becomes wedged between an inserted coaxial cable and an internal surface 259 of the base.

Figure 3A:
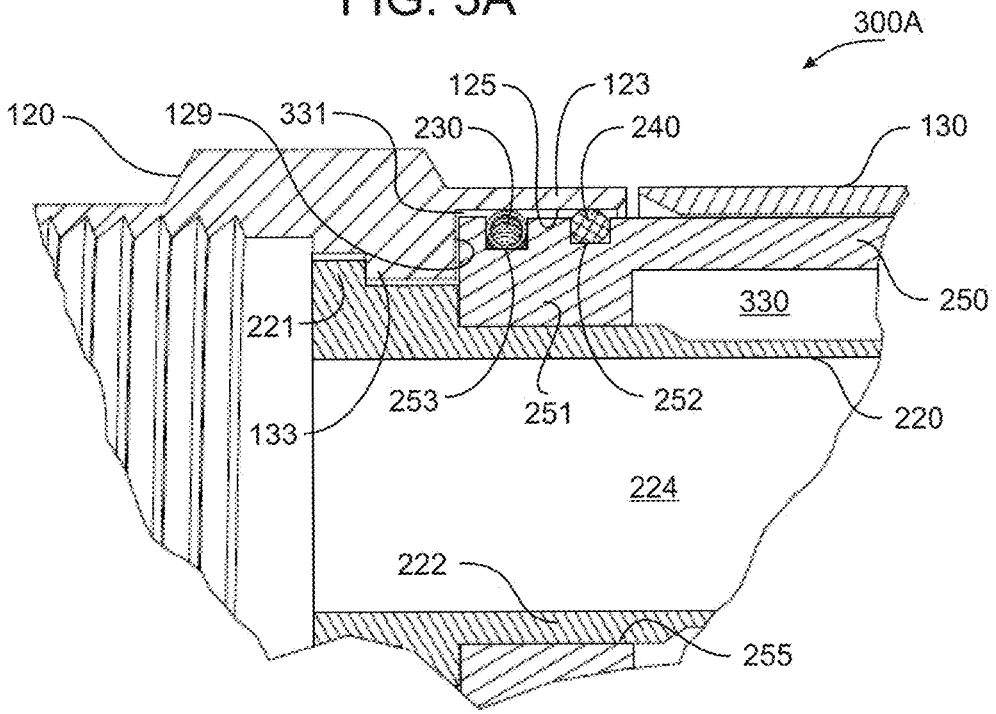
FIG. 3A shows an enlarged cross-sectional view of a coupling end of the connector of FIG. 1A above.

FIG. 3A shows an assembled connector partial cross section 300A. The nut 120 is rotatably engaged with the post 220 via the post flange 221 and the nut inwardly directed rim 133 while the body 250 is fixedly engaged with the post via post shank portion 222 and the body collar 255. In a slidably engaged arrangement, the end cap 130 is fitted over the body 250 for providing relative motion therebeteween.

Note that in FIG. 3A the end cap 130 is shown in near abutment with the nut 120. Although this is the position of the end cap typically following installation of the connector on a coaxial cable, no coaxial cable is show for clarity. Were a coaxial cable shown, its center conductor and surrounding dielectric would be shown inserted in the central chamber 224 of the post 220 and its outer conductor and jacket would be shown inserted in the annular chamber 330 formed between the body 250 and the post 220.

In the embodiment shown, fitments engaging the base 251 of the connector body 250 include a spring such as a coil spring 230 fitted into the base forward groove 253 and a ring such as an O-Ring 240 fitted into the base rear groove 252. As seen, the spring and the ring project from respective forward and rear grooves 253, 252 and contact an inner surface 125 of the nut socket 123. In various embodiments, the projecting spring and ring traverse a gap 331 between the socket and one or more surfaces of the body base discussed further below. As skilled artisans will appreciate, the nut socket 123 rotates with the nut such that when the nut rotates relative to the body 250 there is relative motion between two or more of the socket, the spring, the O-Ring, and the body base. In various embodiments, there is relative motion between the socket and the spring and between the socket and the O-Ring.

Figure 3B:
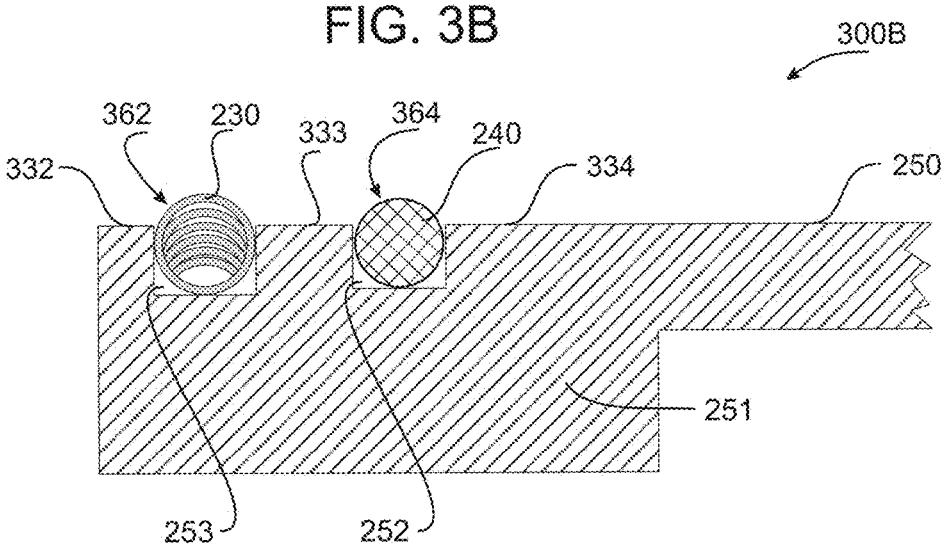
FIGS. 3B-D show enlarged cross-sectional views of alternative body portions for use with the connector of FIG. 1A above.

FIG. 3B shows a portion of the body of the connector of FIG. 3A 300B. In particular, the body 250 base 251 is shown. As mentioned above, the spring 230 and the ring 240 project from the body base grooves 253, 252 and contact an inside surface 125 of the nut 120 socket 123. As seen, body surface portions flank each of the spring projection 362 and the ring projection 364.

In particular, the spring projection 362 is flanked by body surfaces 332 and 333 while the ring projection 364 is flanked by body surfaces 333 and 334. The body surfaces are, in various embodiments, cylindrical faces spaced apart from a cylindrical boundary formed by the inside surface 125 of the socket 123. In various embodiments the spaced apart parts form a gap 331 with a consistent measure. And, in various embodiments the spaced apart parts form a gap 331 with a varying measure; for example, an arrangement tending to cooperate in biasing the nut in an axial direction along the connector longitudinal axis and in a radial direction perpendicular to the connector longitudinal axis.

Figure 3C:
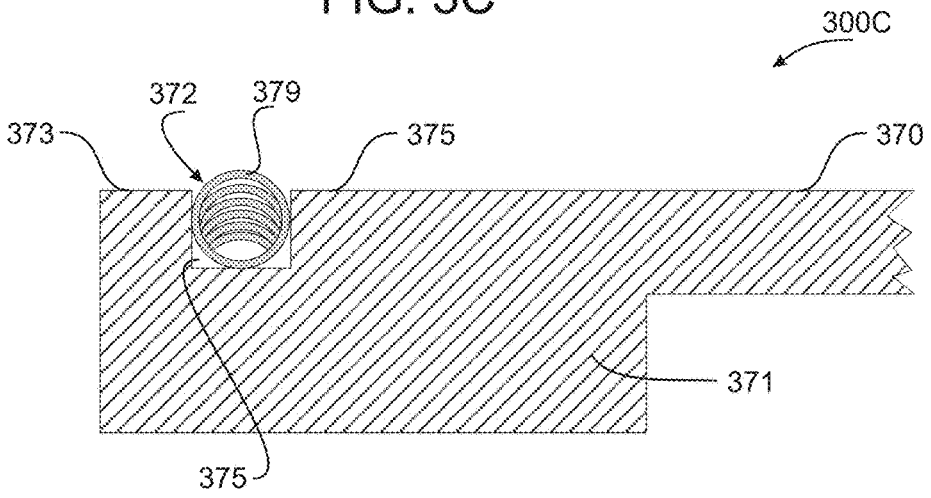

FIG. 3C shows an alternative connector body 300C. In this alternative connector body 370, the body base 371 has a single ring groove. For example, a spring groove 375 is for seating a spring 379 that is flanked by body surfaces 373, 375 which are, in various embodiments, cylindrical faces spaced apart from a cylindrical boundary formed by the inside surface 125 of the socket 123. In various embodiments the spaced apart parts form a gap 331 with a consistent measure. And, in various embodiments the spaced apart parts from a gap 331 with a varying measure; for example, an arrangement tending to cooperate in biasing the nut in an axial direction along the connector longitudinal axis and in a radial direction perpendicular to the connector longitudinal axis. As skilled artisans will understand, a ring such as an O-Ring seal may be located elsewhere in the connector to achieve a similar sealing effect.

Figure 3D:
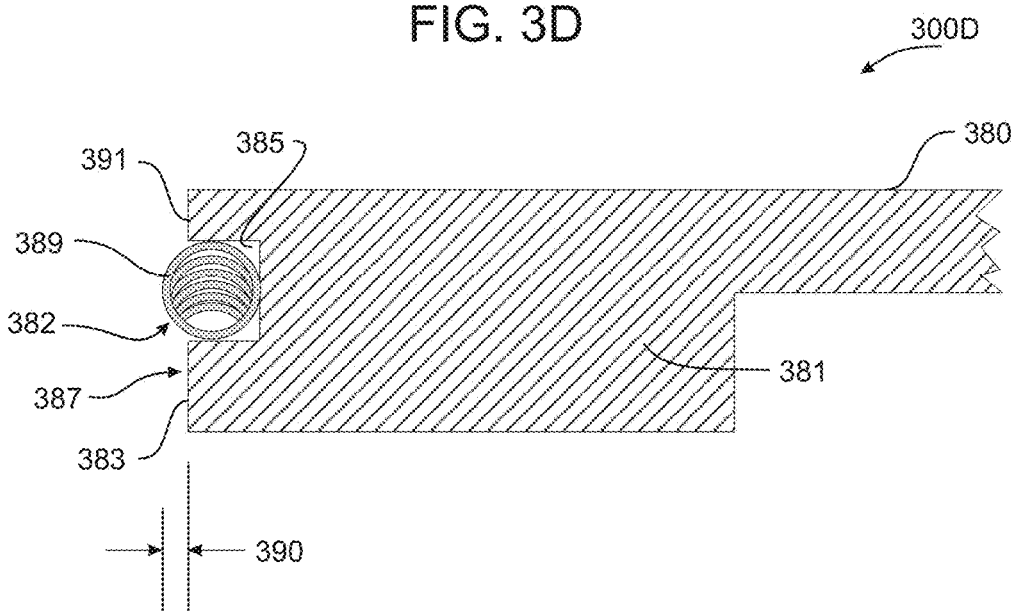

FIG. 3D shows an alternative connector body 300D. In this alternative connector body 380, the body base 381 has no spring groove and no ring groove in the body's cylindrical periphery. Rather, embodiments provide a single spring groove 385 formed in the base 381 end face 387. A spring 389 seated in the groove flanked by annular face surfaces 391, 383. A portion of the spring projecting from the groove 382 traverses a gap 390 to contact an internal annular nut face 129. In various embodiments the spaced apart parts form a gap 390 with a consistent measure. And, in various embodiments the spaced apart parts from a gap 390 with a varying measure.

Various embodiments of the invention provide an electrically conductive spring 230, 379, 389 such as a coil spring 230 that is seated in a body 250 groove 252, 253, 375, 385. Spring projections 362, 372, 382 that contact an electrically conductive nut electrically interconnect the nut with an electrically conductive body such that an electrical circuit is created between the nut and the outer conductor of a coaxial cable engaging an electrically conductive post 220. When the nut engages a mating female connector, this electrical circuit extends from a female connector mating portion, such as metal portion with external threads, to the outer conductor of the coaxial cable that engages the post. As such, embodiments of the present invention provide reliable electrical continuity along a signal ground path established when coaxial cable connectors are mated. And, as skilled artisans will understand, this signal ground path enhances the reliability of signal transport through mated coaxial connectors, even when the male and female connectors are not tightly interengaged.

Figure 4A:
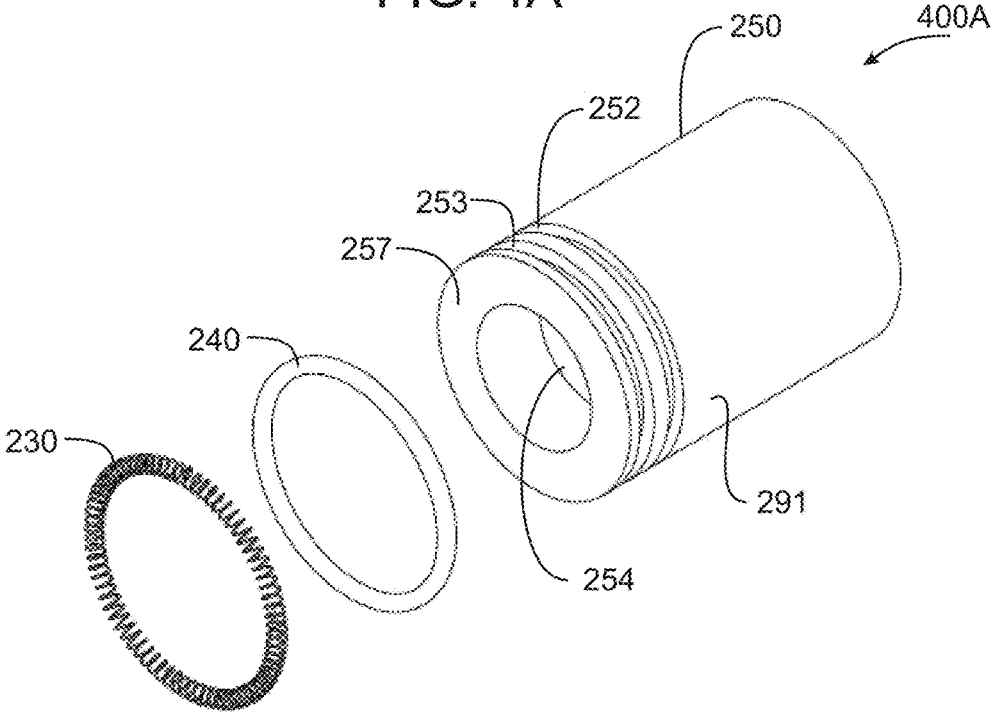
FIG. 4A shows an exploded view of a body assembly of the connector of FIG. 1A above.

FIG. 4A shows a exploded diagram of a connector body with selected fitments 400A. In particular, a connector body 250 with a central through hole 254 defines an annular end face 257. Adjacent forward 253 and rear 252 grooves in an external cylindrical surface 291 of the body provide a means for seating selected body fitments. As shown in the figure, a ring element 240 is for fitment to the rear groove 252 and a spring element such as a coil spring element 230 is for fitment to the forward groove 253. Notably, embodiments of the connector body provide a rigid unitary structure while embodiments of the spring and ring provide elements that can be seated in the grooves via one or more of extension and/or means for interengaging opposing ends of a generally linear structure that may not be extensible.

Figure 4B:
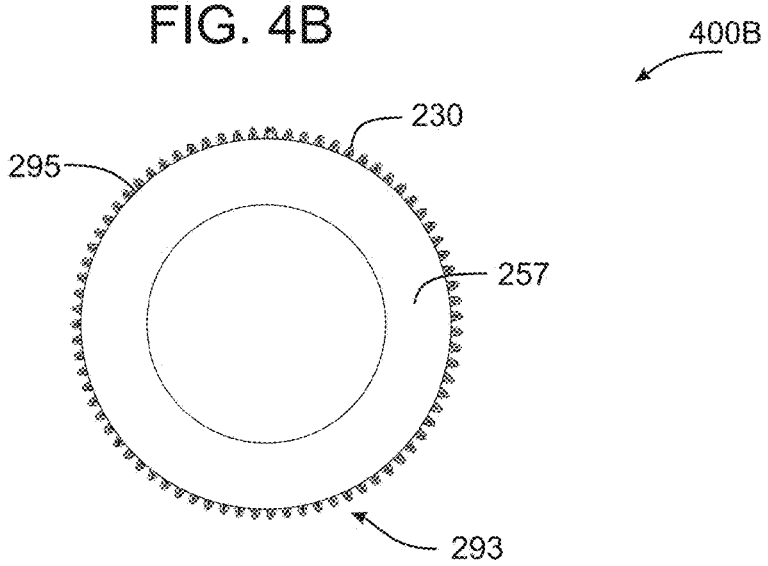
FIG. 4B shows an end view of the assembly of FIG. 4A.

FIG. 4B shows an end view of the body and spring of FIG. 4A 400B. This end view exposes the body annular end face 257. Here, the coil spring 230 is shown seated in a body groove such as the front body groove 253. Around a periphery of the body 295 a portion of the spring 293 is seen to project from the groove. It is noted that such body end face views provide visual descriptions of the spring and its relationship to the groove. In particular, to the extent the spring projects from the body groove this feature is shown.

As seen above, a spring such as a coil spring 230 can be usefully located between the body 250 and the nut 120. Embodiments above include ones placing a spring in a connector body groove 252, 253. FIGS. 5A-J and 6A-G below depict embodiments including a spring extending at least partially around a circumference of a connector body.

Figure 5A:
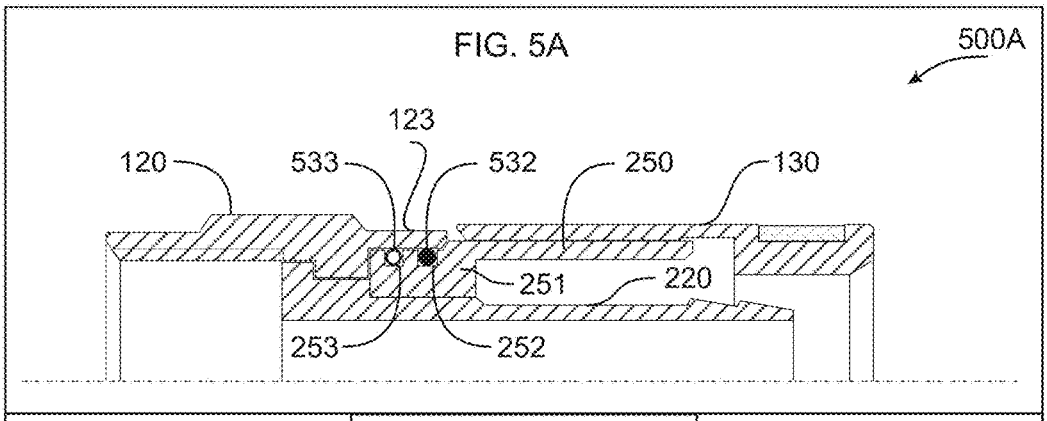
FIG. 5A shows a cross-sectional view illustrating a first group for use with connectors similar to the connector of FIG. 1A above.

FIG. 5A shows a partial cross section of a connector in accordance with the present invention 500A. A connector post 220 rotatably engages a connector coupling such as a nut 120 and a connector body 250 is tightly coupled to the post. While the end cap 130 is shown slidably engaging the body, no coaxial cable and no cable fixation, such as a dual diameter seal, are shown for clarity.

Circumferential grooves 252, 253 in the connector body base 251 are provided to seat inserts 533, 532 at least partially therein such that embodiments provide for contact between each insert and the nut 120, as at the nut socket 123. In various embodiments, one insert is a spring and in various embodiments another insert is a spring or a seal.

Figure 5B:
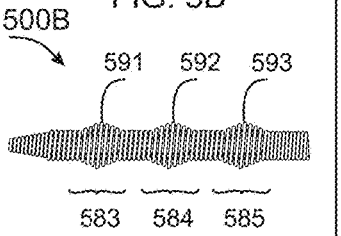
FIGS. 5B-D show endless continuity springs for use with the connector of FIG. 5A above.
Figure 5C:
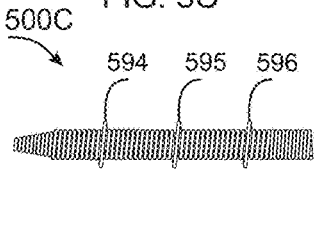
Figure 5D:
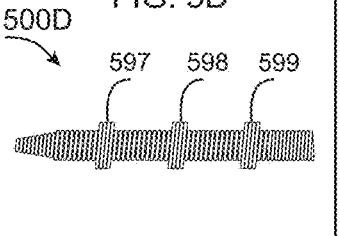
Figure 5E:
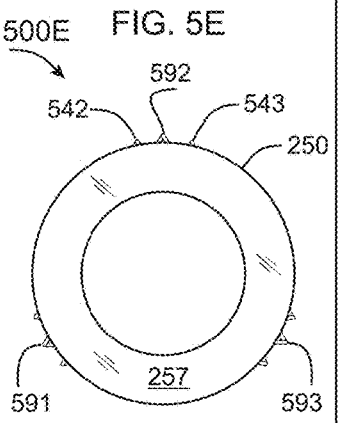
FIGS. 5E-G show end views of body assemblies for use with the connector of FIG. 5A above.
Figure 5F:
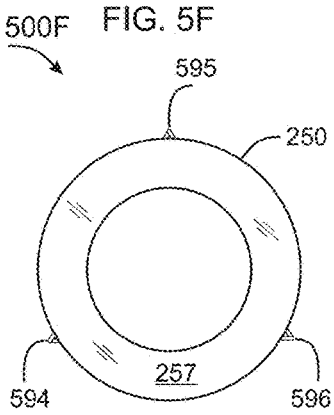
Figure 5G:
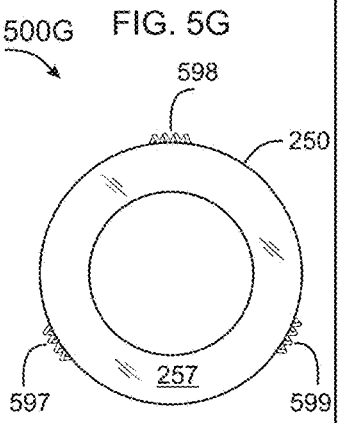
Figure 5H:
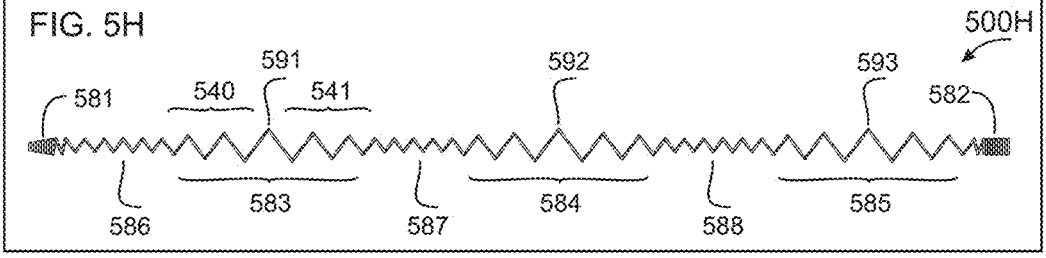
FIGS. 5H-J show endless continuity springs for use with the connector of FIG. 5A above.

FIGS. 5B, 5E, 5H show a first endless spring insert 500B, 500E, 500H. In particular, FIG. 5B shows a spring 500B, FIG. 5E shows an end view of the spring and a body 500E, and FIG. 5H shows the spring elongated 500H.

FIG. 5B shows the first endless spring 500B before its ends are interengaged to form an endless spring. The spring is a coil format spring with one or more large diameter peaks. As shown, the spring has three contact zones or regions 583, 584, 585 and each contact zone includes a respective peak 591, 592, 593.

FIG. 5E shows the first endless spring encircling the body when its ends are interengaged 500E. The figure shows body end face 257 and the first endless spring 500B seated in a groove 252, 253 of the body 250. As seen, spring coils that are spring peaks 591, 592, 593 project from the groove. In some embodiments one or more peak flanking coils 542, 543 also project from the groove.

FIG. 5H shows the first endless spring in an elongated condition 500H. As seen, the spring has end to end fastening means such as pin 581 and socket 582 means for interengaging opposing ends to form an endless spring. As skilled artisans will understand, other than pin and socket means may be used to fashion endless springs. For example, welding, continuous loop fabrication, and other means such as other mechanical means may be used to fashion endless springs in one or more embodiments of the present invention.

The embodiment shown has three peaks 591, 592, 593 in respective contact regions 583, 584, 585 such that the pin and first contact region are coupled by a first spring root region 586, the first contact region and the second contact region are coupled by a second spring root region 587, and the second contact region and the third contact region are coupled by a third spring root region 588. As shown, the peaks of the contact regions are flanked by spring coil(s) of increasing diameter in an entry zone 540 and flanked by spring coil(s) of decreasing diameter in an exit zone 541.

Figure 5I:
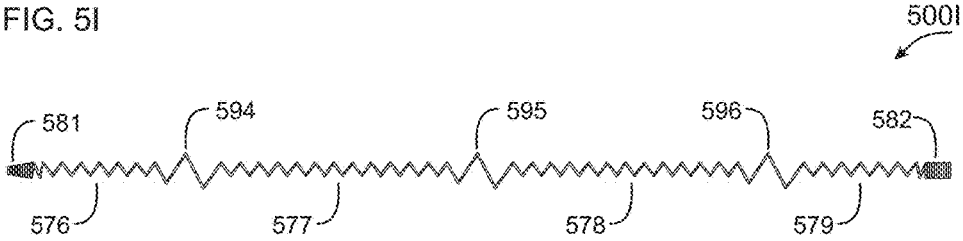

FIGS. 5C, 5F, 5I show a second endless spring insert 500C, 500F, 500I. In particular, FIG. 5C shows a spring 500C, FIG. 5F shows an end view of the spring and a body 500F, and FIG. 5I shows the spring elongated 500I.

FIG. 5C shows the second endless spring 500C before its ends are interengaged to form an endless spring. The spring is a coil format spring with one or more large diameter peaks. As shown, the spring has three large diameter peaks 594, 595, 596.

FIG. 5F shows the second endless spring encircling the body when its ends are interengaged 500F. The figure shows body end face 257 and the second endless spring 500C seated in a groove 252, 253 of the body 250. As seen, spring coils that are spring peaks 594, 595, 596 project from the groove.

FIG. 5I shows the second endless spring in an elongated condition 500I. As seen, the spring has end to end fastening means such as pin 581 and socket 582 means for interengaging opposing ends to form an endless spring. The embodiment shown has three peaks 594, 595, 596. The pin and first peak are coupled by a first spring root region 576, the first and second peaks are coupled by a second spring root region 577, the second and third peaks are coupled by a third spring root region 578, and the third peak and socket 582 are coupled by a fourth spring root region 579.

Figure 5J:
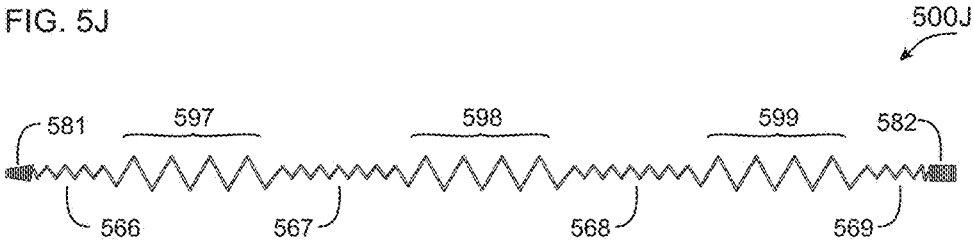

FIGS. 5D, 5G, 5J show a third endless spring insert 500D, 500G, 500J. In particular, FIG. 5D shows a spring 500D, FIG. 5G shows an end view of the spring and a body 500G, and FIG. 5J shows the spring elongated 500J.

FIG. 5D shows the third endless spring 500D before its ends are interengaged to form an endless spring. The spring is a coil format spring with one or more groups of large diameter peaks. As shown, the spring has three groups of contact peaks 597, 598, 599.

FIG. 5G. shows the third endless spring encircling the body when its ends are interengaged 500G. The figure shows body end face 257 and the third endless spring 500D seated in a groove 252, 253 of the body 250. As seen, spring coils of spring peak groups 597, 598 599 project from the groove.

FIG. 5J shows the third endless spring in an elongated condition 500J. As seen, the spring has end to end fastening means such as pin 581 and socket 582 means for interengaging opposing ends to form an endless spring. The embodiment shown has three groups of peaks 597, 598, 599 such that the pin and first group of peaks are coupled by a first spring root region 566, the first group of peaks and the second group of peaks are coupled by a second spring root region 567, the second group of peaks and the third group of peaks are coupled by a third spring root region 568, and the third group of peaks and the socket are coupled by a fourth spring root region 569.

Insert materials such as spring materials include any of those known by skilled artisans to be suitable including resilient electrical conductors. Useful metals and/or their alloys include iron, steel, copper, nickel, beryllium, and the like. In an embodiment, the spring is made from a stainless steel and in an embodiment the spring is made from an alloy comprising beryllium and/or copper. In some embodiments, the spring is coated as with gold or another material which may be selected to reduce rubbing friction between the spring and a contacting part such as a coupling. Various embodiments provide an insert that electrically couples the nut and the body.

Figure 6A:
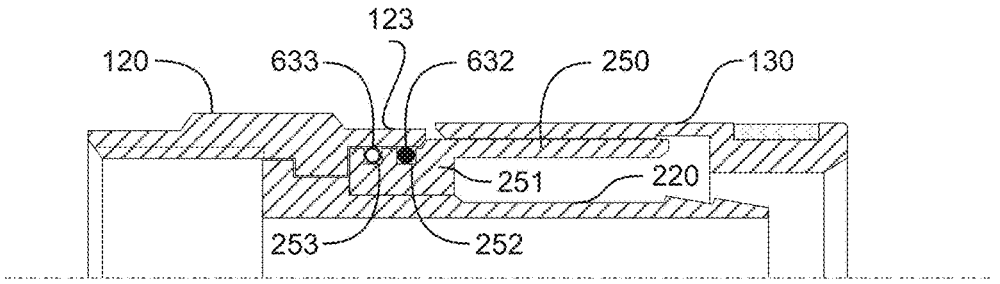
FIG. 6A shows a cross-sectional view illustrating a second group of connectors similar to the connector of FIG. 1A above.

FIG. 6A shows a partial cross section of a connector in accordance with the present invention 600A. A connector post 220 rotatably engages a connector coupling such as a nut 120 and a connector body 250 is tightly coupled to the post. While the end cap 130 is shown slidably engaging the body, no coaxial cable and cable fixation such as a dual diameter seal is shown for clarity.

Circumferential grooves 252, 253 in the connector body base 251 are provided to seat inserts 633, 632 at least partially therein such that embodiments provide for contact between each insert and the nut 120 as at the nut socket 123. In various embodiments, one insert is a spring and in various embodiments another insert is a spring or a seal such as an O-Ring seal.

Figure 6B:
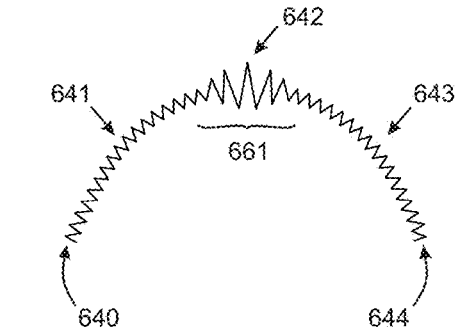
FIGS. 6B-C show non-endless continuity springs for use with the connector of FIG. 6A above.
Figure 6C:
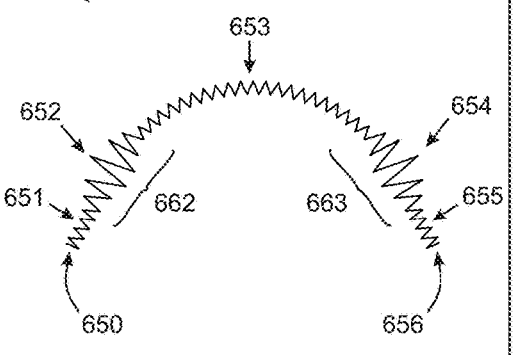
Figure 6D:
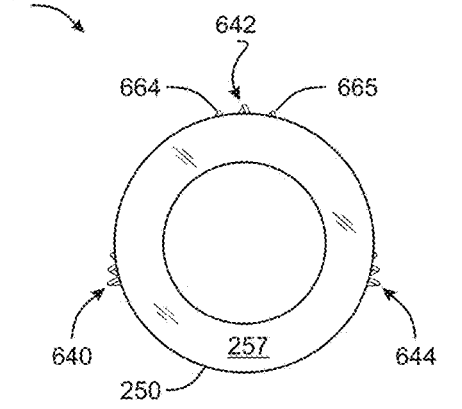
FIGS. 6D-E show end views of body assemblies for use with the connector of FIG. 6A above.
Figure 6E:
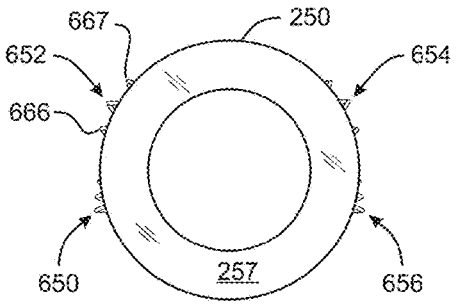
Figure 6F:
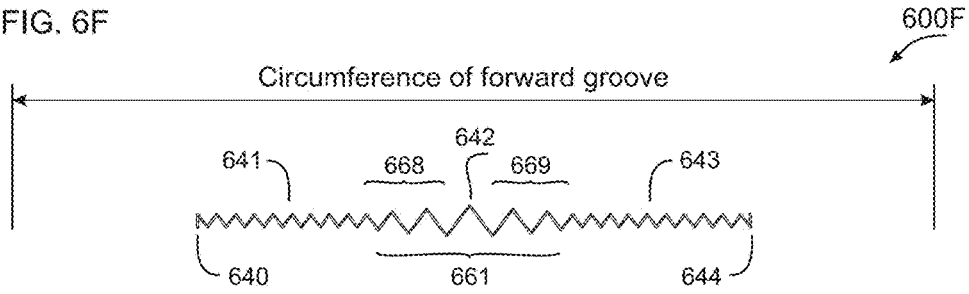
FIGS. 6F-G show non-endless continuity springs for use with the connector of FIG. 6A above.

FIGS. 6B, 6D, 6F show a first open loop spring insert 600B, 600D, 600F. In particular, FIG. 6B shows a spring 600B, FIG. 6D shows an end view of the spring and a body 600D, and FIG. 6F shows the spring elongated 600F.

FIG. 6B shows the first open loop spring 600B. The spring is a coil format spring with one or more large diameter peaks. As shown, the spring has one contact zone 661 that includes a peak formed by a large diameter spring coil 642.

FIG. 6D shows the first open loop spring partially encircling the body 600D. The figure shows body end face 257 and the first open loop spring 600B seated in a groove 252, 253 of the body 250. As seen, a relatively larger spring coil (see also description below) forms a peak 642 that projects from the groove. In some embodiments one or more peak flanking coils 664, 665 also project from the groove.

In various embodiments, open loop spring ends 640, 644 project from the groove 252, 253 of the body. As shown in FIG. 6D, one or more spring coils at each end of the spring project from the groove.

FIG. 6F shows the first open loop spring in an elongated condition 600F. As seen, the spring has free ends 640, 644. The embodiment shown has one peak 642 in one contact region 661 such that the first free end 640 and the contact region are coupled by a first spring root region 641 and the first contact region and the second free end 644 are coupled by a second spring root region 643. As shown, the peak of the contact region is flanked by spring coil(s) of increasing diameter in an entry zone 668 and flanked by spring coil(s) of decreasing diameter in an exit zone 669.

Figure 6G:
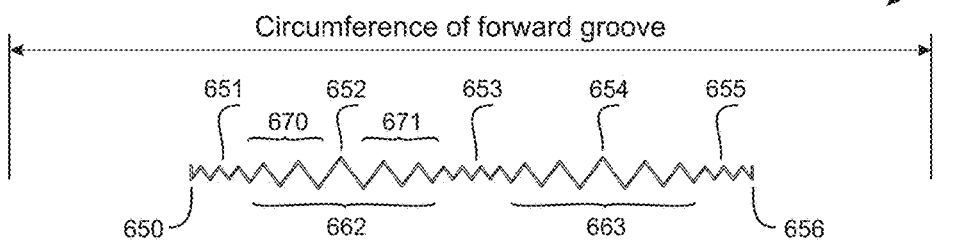

FIGS. 6C, 6E, 6G show a second open loop spring insert 600C, 600E, 600G. In particular, FIG. 6C shows a spring 600C, FIG. 6E shows an end view of the spring and a body 600E, and FIG. 6G shows the spring elongated 600G.

FIG. 6C shows the second open loop spring 600C. The spring is a coil format spring with one or more large diameter peaks. As shown, the spring has two contact zones 662, 663 that include respective peaks 652, 654 formed, for example, by large diameter spring coils.

FIG. 6E. shows the second open loop spring partially encircling the body 600E. The figure shows body end face 257 and the second open loop spring 600C seated in a groove 252, 253 of the body 250. As seen, relatively larger spring coils (see also description below) form respective peaks 652, 654 that project from the groove. In some embodiments one or more peak flanking coils 666, 667 also project from the groove.

In various embodiments, open loop spring ends 650, 656 project from the groove 252, 253 of the body. As shown in FIG. 6E, one or more spring coils at each end of the spring project from the groove.

FIG. 6G shows the second open loop spring in an elongated condition 600G. As seen, the spring has free ends 650, 656. The embodiment shown has two peaks 652, 654 and respective contact regions 662, 663 such that the first free end 650 and the first contact region are coupled by a first spring root region 651, the first contact region and the second contact region are coupled by a second spring root region 653, and the second contact region and second free end are coupled by a third spring root region 655. As shown, the peaks of the contact regions may be flanked by spring coil(s) of increasing diameter such as shown in an exemplary entry zone 670 and flanked by spring coil(s) of decreasing diameter such as shown in an exemplary exit zone 671.

In some embodiments, the connector body grooves do not traverse a full circle. Rather, their traverse is an open loop. Here, inserts are again open loop inserts and include suitable ones of those mentioned above. As skilled artisans will understand, open loop grooves will be shorter than corresponding closed loop grooves and therefore open loop groove inserts will be length limited by comparison.

Insert materials such as spring materials include any of those known by skilled artisans to be suitable including resilient electrical conductors. Useful metals and/or their alloys include iron, steel, copper, nickel, beryllium, and the like. In an embodiment, the spring is made from a stainless steel and in an embodiment the spring is made from an alloy comprising beryllium and/or copper. In some embodiments, the spring is coated as with gold or another material which may be selected to reduce rubbing friction between the spring and a contacting part such as a coupling. Various embodiments provide an insert that electrically couples the nut and the body.

Figure 7A:
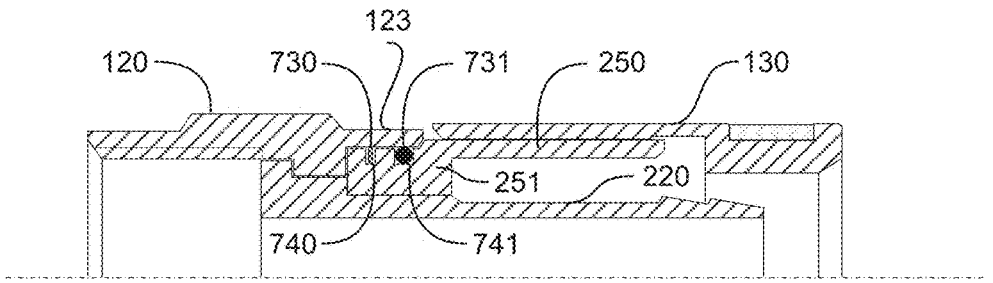
FIG. 7A shows a cross-sectional view illustrating a third connector group similar to the connector of FIG. 1A above.

FIG. 7A shows a partial cross section of a connector in accordance with the present invention 700A. A connector post 220 rotatably engages a connector coupling such as a nut 120 and a connector body 250 is tightly coupled to the post. While the end cap 130 is shown slidably engaging the body, no coaxial cable and no cable fixation, such as a dual diameter seal, are shown for clarity.

Circumferential grooves 740, 741 in the connector body base 251 are provided to seat inserts 730, 731 at least partially therein such that embodiments provide for contact between each insert and the nut 120 as at the nut socket 123. In various embodiments, one insert is a spring and in various embodiments another insert is a spring or a seal such as an O-Ring seal.

Figure 7B:
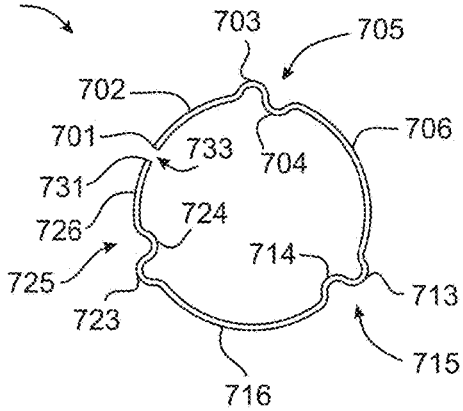
FIGS. 7B-C show elevation and side views of an undulating continuity member for use with the connector of FIG. 7A above.
Figure 7C:
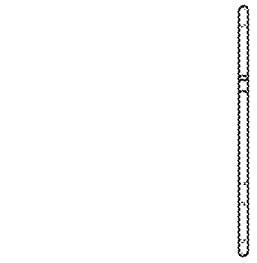

FIGS. 7B, 7C show elevation and side views of an undulating loop spring 700B, 700C. In particular, FIG. 7B shows an elevation view of the spring 700B while FIG. 7C shows a side view of the spring 700C.

Unlike the coil springs mentioned above, the undulating loop spring is a substantially planar spring form describing a single loop that is open in some embodiments. Embodiments of open loop springs resist both increases and decreases in a gap 733 between first and second spring ends 701, 731.

As shown, the spring has three peaks 703, 713, 723 and each peak is adjacent to a respective similarly shaped valley 704, 714, 724. Peak/valley pairs form respective first, second and third contact regions 705, 715, 725 with a first spring root region 706 between the first and second contact regions, a second spring root region 716 between the second and third contact regions. The gap 733 of the open loop spring is flanked by a first spring root section 702 extending from the first contact region and by a second spring root section 726 extending from the third contact region.

Figure 7D:
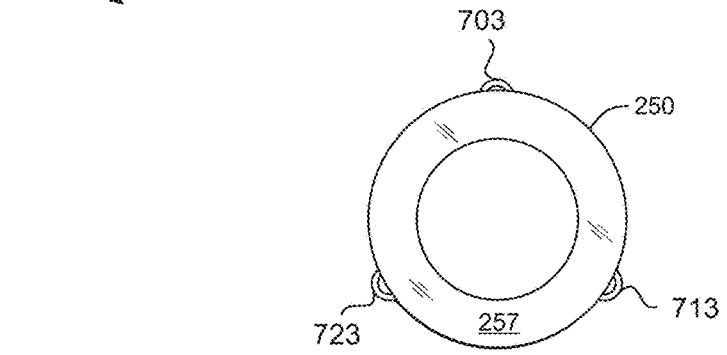
FIG. 7D shows an end views of a body assembly for use with the connector of FIG. 7A above.

FIG. 7D. shows the first undulating loop spring partially encircling the body 700D. The figure shows body end face 257 and the first open loop spring 700B seated in a groove 740, 741 of the body 250. As seen, the spring peaks 703, 713, 723 project from the groove. In various embodiments, one or more contact groups provide one or more respective projections from the groove. Notably, the springs described above may be seated in body 250 base 251 grooves of varying cross section. In some embodiments, a groove is configured to accommodate planar and/or torsional action of the spring.

In various embodiments, the undulating loop spring 700B, 700C is replaced by another resilient member. For example, alternatives include a washer like retaining ring and an undulating band.

Insert materials such as spring materials include any of those known by skilled artisans to be suitable including resilient electrical conductors. Useful metals and/or their alloys include iron, steel, copper, nickel, beryllium, and the like. In an embodiment, the spring is made from a stainless steel and in an embodiment the spring is made from an alloy comprising beryllium and/or copper. In some embodiments, the spring is coated as with gold or another material which may be selected to reduce rubbing friction between the spring and a contacting part such as a coupling. Various embodiments provide an insert that electrically couples the nut and the body.

FIGS. 8A-D show body base grooves of varying cross section 800A-D. As skilled artisans will understand, springs may conform to the one or more of the groove cross sections or springs may have discrete contact points with the groove. In particular, coil spring embodiments having other than circular loops may be accommodated by embodiments of the grooves described below.

Figure 8A:
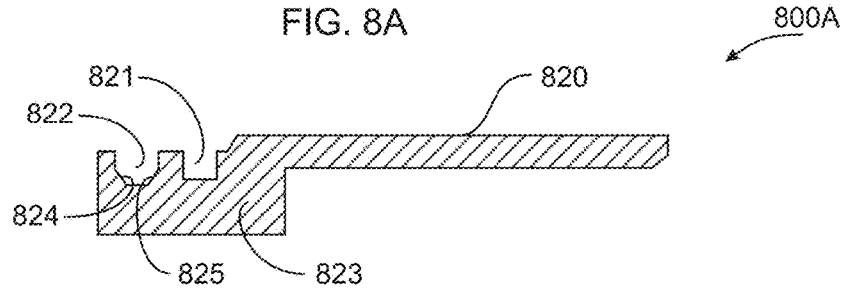
FIGS. 8A-D show partial cross-sections of alternative body members for use with selected connectors similar to the connector of FIG. 1A above.

FIG. 8A shows a first groove configuration 800A. A body 820 includes a body base 823. The body base includes rear and forward grooves 821, 822. A rectangle or square describes the cross section of the rear groove. Similar to the rear groove, the front groove has chamfered internal corners 824, 825.

Figure 8B:
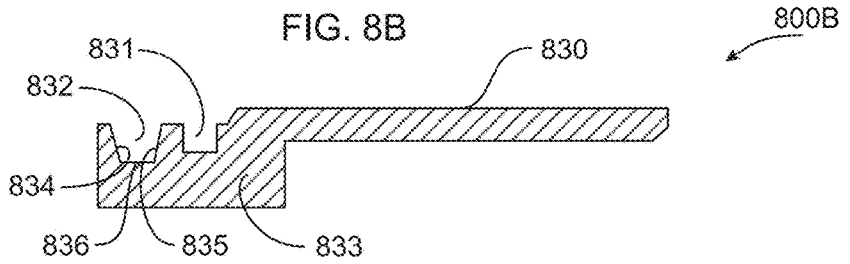

FIG. 8B shows a second groove configuration 800B. A body 830 includes a body base 833. The body base includes rear and forward grooves 831, 832. A rectangle or square describes the cross section of the rear groove. Sloped sidewalls 834, 835 and a flat bottom 836 describe the cross section of the forward groove.

Figure 8C:
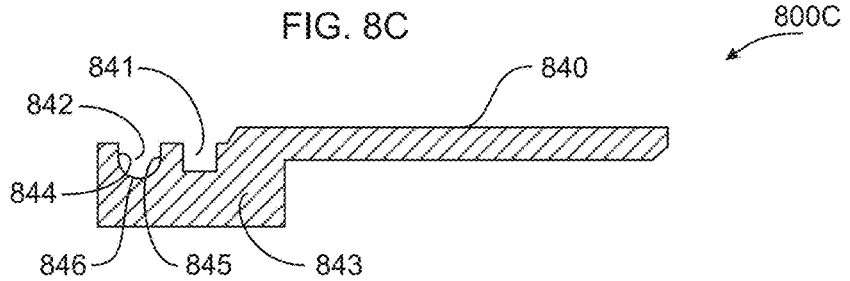

FIG. 8C shows a third groove configuration 800C. A body 840 includes a body base 843. The body base includes rear and forward grooves 841, 842. A rectangle or square describes the cross section of the rear groove. Vertical sidewalls 844, 845 and a rounded bottom 846 describe the cross section of the forward groove.

Figure 8D:
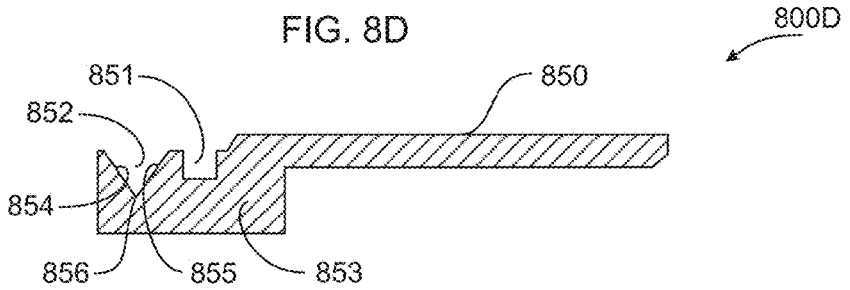

FIG. 8D shows a fourth groove configuration 800D. A body 850 includes a body base 853. The body base includes rear and forward grooves 851, 852. A rectangle or square describes the cross section of the rear groove. Sidewalls 854, 855 sloped to form a "V" shape with a vertex 856 describe the cross section of the forward groove.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A coaxial connector comprising:

a nut having a forward mouth and a trailing socket and a body having a base;

the nut, the body, and a post in coaxial arrangement about a connector longitudinal axis;

the post rotatably engaging the nut and fixedly engaging the body;

a groove in a radial surface of the body base, the groove formed along a curved line such that the groove encircles at least a portion of the body base;

a coil spring in the groove and a nut socket that encircles the spring;

a socket rubbing surface adjacent to the groove; and, at least one coil of the coil spring contacting the rubbing surface.

2. The connector of claim 1 wherein the coil spring electrically couples the nut and the body.

3. The connector of claim 2 further comprising:

first and second ends of the coil spring and a gap therebetween.

4. The connector of claim 2 further comprising:

joined coil spring ends.

5. The connector of claim 1 wherein the contacting coil projects radially from the groove.

6. The connector of claim 5 wherein plural coils of the coil spring coil do not contact the rubbing surface.

7. The connector of claim 5 wherein coils flanking the contacting coil do not contact the rubbing surface.

8. A coaxial connector for transporting radio frequency signals, the connector comprising:

a body and a nut in coaxial arrangement about a connector longitudinal axis;

the nut rotatably coupled to the body;

a groove in a surface of a body base portion, the groove formed along a curved line;

a coil spring inserted between opposed groove sidewalls;

the nut having a rubbing surface opposite the groove; and, at least one coil of the coil spring contacting the rubbing surface;

wherein an interior surface of the nut defines the rubbing surface.

9. The connector of claim 8 wherein the opposed groove sidewalls restrain axial movement of the spring toward the nut and restrain axial movement of the spring toward a distal end of the body.

10. The connector of claim 9 wherein the rubbing surface overhangs the spring.

11. The connector of claim 8 wherein a groove bottom lies between the groove sidewalls and the sidewalls extend radially beyond the groove bottom.

12. The connector of claim 8 wherein a groove bottom lies between the groove sidewalls and the sidewalls extend axially beyond the groove bottom.

13. The connector of claim 8 wherein a width of the groove is at least equal to but not more than two times a spring coil diameter.

14. The connector of claim 8 wherein no groove sidewall is parallel to the connector axis.

15. The connector of claim 8 wherein no groove sidewall is perpendicular to the connector axis.

16. A coaxial connector comprising:

a nut, body, and post in coaxial arrangement, the post rotatably coupling the nut to the body;

a body neck engaging the post and a groove in the body neck;

a coil spring in the groove;

a nut socket interior that retains the coil spring in the groove; and, at least one, but not all coils of the spring electrically interconnecting the nut and the body.

17. The connector of claim 16 wherein opposed groove sidewalls restrain axial movement of the spring toward the nut and restrain axial movement of the spring toward a distal end of the body.

18. The connector of claim 16 wherein a groove bottom lies between groove sidewalls and the sidewalls extend radially beyond the groove bottom.

19. The connector of claim 16 wherein opposite sides of a coil electrically interconnect the nut and the body.

20. The connector of claim 16 wherein a width of the groove is at least equal to but not more than two times a spring coil diameter.

21. The connector of claim 16 wherein the groove extends between sidewalls and no groove sidewall is parallel to the connector axis.

* * * * *